US009941646B1

(12) United States Patent
Hashimoto et al.

(10) Patent No.: US 9,941,646 B1
(45) Date of Patent: Apr. 10, 2018

(54) COAXIAL CABLE CONNECTOR AND METHOD OF USE THEREOF

(71) Applicant: DAI-ICHI SEIKO CO., LTD., Kyoto (JP)

(72) Inventors: Yoichi Hashimoto, Tokyo (JP); Kenichi Yotsutani, Tokyo (JP)

(73) Assignee: DAI-ICHI SEIKO CO., LTD., Kyoto (JP)

( * ) Notice: Subject to any disclaimer, the term of this patent is extended or adjusted under 35 U.S.C. 154(b) by 0 days.

(21) Appl. No.: 15/679,403

(22) Filed: Aug. 17, 2017

(30) Foreign Application Priority Data

Oct. 6, 2016 (JP) ..... 2016-198544

(51) Int. Cl.

| | |
|---|---|
| ***H01R 9/05*** | (2006.01) |
| ***H01R 24/40*** | (2011.01) |
| ***H01R 13/646*** | (2011.01) |
| ***H01R 13/658*** | (2011.01) |
| ***H01R 13/648*** | (2006.01) |
| ***H01R 24/44*** | (2011.01) |
| ***H01R 43/20*** | (2006.01) |
| *H01R 103/00* | (2006.01) |
| *H01R 13/52* | (2006.01) |

(52) U.S. Cl.
CPC ..... *H01R 24/40* (2013.01); *H01R 13/646* (2013.01); *H01R 13/648* (2013.01); *H01R 13/65802* (2013.01); *H01R 24/44* (2013.01); *H01R 43/20* (2013.01); *H01R 13/5202* (2013.01); *H01R 2103/00* (2013.01)

(58) Field of Classification Search
CPC ..... H01R 24/58; H01R 13/53; H01R 17/12; H01R 9/0518
See application file for complete search history.

(56) References Cited

U.S. PATENT DOCUMENTS

| | | | | |
|---|---|---|---|---|
| 6,607,400 | B1 * | 8/2003 | Ko | H01R 24/50 439/578 |
| 7,351,067 | B2 * | 4/2008 | Chen | H01R 9/0518 439/581 |
| 7,445,458 | B1 * | 11/2008 | Yamane | H01R 4/028 439/63 |
| 8,876,552 | B2 * | 11/2014 | Taguchi | H01R 24/54 439/582 |

FOREIGN PATENT DOCUMENTS

| | | |
|---|---|---|
| JP | H08-096899 | 4/1996 |
| JP | 2006-164791 A | 6/2006 |

* cited by examiner

*Primary Examiner* — Phuong Chi T Nguyen
(74) *Attorney, Agent, or Firm* — Studebaker & Brackett PC

(57) ABSTRACT

A coaxial cable connector comprises a signal contact member having an inner conductor connecting portion, a grounding contact member, and an insulating housing for supporting the signal contact member and the grounding contact member in a condition of mutual isolation, wherein the insulating housing is provided with first and second holes opposite to each other across the inner conductor connecting portion of the signal contact member with which an inner conductor of a coaxial cable is in contact, the first hole is operative to allow an ultrasonic vibration horn to be put into the first hole for contacting with the inner conductor of the coaxial cable and applying ultrasonic vibrations to the same and the second hole is operative to allow an anvil to be put into the second hole for coming into contact with the inner conductor connecting portion of the signal contact member.

9 Claims, 10 Drawing Sheets

COAXIAL CABLE CONNECTOR AND METHOD OF USE THEREOF

BACKGROUND OF THE INVENTION

Field of the Invention

The present invention relates generally to a coaxial cable connector, and more particularly to an improvement in a coaxial cable connector which has a signal contact member and a grounding contact member insulated from each other to be connected respectively with an inner conductor and an outer conductor insulated from each other of a coaxial cable which is provided, in addition to the inner conductor and the outer conductor, with an internal insulator put between the inner conductor and the outer conductor for surrounding the inner conductor and an external insulator surrounding the outer conductor, and further relates to a method of connecting the coaxial cable with the coaxial cable connector.

Description of the Prior Art Including Information Disclosed Under 37 CFR 1.97 and 37 CFR 1.98

There has been often utilized a coaxial cable having an inner conductor, an outer conductor, an internal insulator put between the inner conductor and the outer conductor for surrounding the inner conductor and an external insulator provided for surrounding the outer conductor for transmitting a high-frequency signal between electrical parts, electric equipments or electronic apparatus. The high-frequency signal transmitted through the coaxial cable is put in a condition of electro-magnetic shield so as to be inactive to leak out from the inner conductor or to prevent electromagnetic noises from mixing thereinto from the outside. For example, the coaxial cable is connected with a circuit board on which high-frequency signals are dealt with and the high-frequency signal is transmitted through the coaxial cable from the circuit board to the outside or from the outside to the circuit board under the condition of electromagnetic shield.

For connecting the coaxial cable with the circuit board, a coaxial cable connector is mounted on an end of the coaxial cable to be coupled with a mating coaxial connector fixed to the circuit board. The coaxial cable connector which is to be mounted on the end of the coaxial cable has a signal contact member with which the inner conductor of the coaxial cable is electrically connected and a grounding contact member with which the outer conductor of the coaxial cable is electrically connected. The mating coaxial connector has a central contact member as a signal contact member to which the high-frequency signal dealt with on the circuit board is supplied and an outer contact member as a grounding contact member provided for surrounding the central contact member to be supplied with a ground potential. When the coaxial cable connector is coupled with the mating coaxial connector on the circuit board, the grounding contact member of the coaxial cable connector engages with the outer contact member of the mating coaxial connector to be electrically connected with the same and the signal contact member of the coaxial cable connector comes into press-contact with the central contact member of the mating coaxial connector to be electrically connected with the same.

For mounting the coaxial cable connector on the end of the coaxial cable as described above, it is required to connect the inner conductor of the coaxial cable with the signal contact member of the coaxial cable connector and also to connect the outer conductor of the coaxial cable with the grounding contact member of the coaxial cable connector. Under such a situation, it is desired especially to put the inner conductor of the coaxial cable in a condition of superior electrical connection with the signal contact member of the coaxial cable connector because the quality of the connecting condition between the inner conductor of the coaxial cable and the signal contact member of the coaxial cable influences directly transmission characteristics of the high-frequency signal transmitted through the coaxial cable.

There have been previously proposed various coaxial cable connectors, with each of which the inner conductor of the coaxial cable is connected with the signal contact member of the coaxial cable connector by means of soldering, as disclosed in, for example, the Japanese patent application published before substantial examination under publication number HEIS-96899 (hereinafter, referred to as published patent document 1), Further, there has been also previously proposed, as a possible approach, a general concept of adopting ultrasonic welding or electric welding instead of the soldering for connecting the inner conductor of the coaxial cable with the signal contact member of the coaxial cable connector, as disclosed in, for example, the Japanese patent application published before substantial examination under publication number 2006-164791 (hereinafter, referred to as published patent document 2).

The previously proposed coaxial cable connector (an electrical connector (20)) disclosed in the published patent document 1 comprises a signal contact member (a contacting terminal (1)) having an inner conductor connecting portion (a wire connecting portion (2)) with which an inner conductor (a core conductor (12)) of a coaxial cable (a cable (10)) is connected and a pair of engaging portions (contacting portions (4)) each extended from the inner conductor connecting portion, a grounding contact member (an outer conductor (21)) having an annular coupling portion (a tubular portion (23)) and a shell portion (an arm portion (24)) extended from the annular coupling portion to be bendable, and an insulating housing (an insulator (22)) having a receptive portion (26) positioned on the inside of the annular coupling portion for receiving the engaging portions therein and a lid portion (27) extended from the receptive portion (26) to be bendable for supporting the signal contact member and the grounding contact member in a condition of mutual isolation. A part of the inner conductor connecting portion of the signal contact member is provided with a groove (6) having a V-shaped portion (6A) and a roundish portion (6B) for engaging with the inner conductor of the coaxial cable.

When the inner conductor of the coaxial cable is electrically connected with the inner conductor connecting portion of the signal contact member, first, the inner conductor of the coaxial cable is put in the groove provided on the inner conductor connecting portion of the signal contact member so as to be guided by the V-shaped portion of the groove for entering into the roundish portion of the groove. Then, the groove is plastically deformed to be narrowed by means of a predetermined tool and the inner conductor of the coaxial cable is tightly held by the groove deformed plastically. After that, the inner conductor of the coaxial cable, an end portion of which is appressed to an outer surface of the inner conductor connecting portion of the signal contact member, is soldered to be electrically connected with the inner conductor connecting portion of the signal contact member.

Further, after the inner conductor of the coaxial cable is connected with the inner conductor connecting portion of the signal contact member by means of soldering, the shell portion of the grounding contact member is bent, together with the lid portion of the insulating housing, toward the coaxial cable having the inner conductor connected with the inner conductor connecting portion of the signal contact member and comes to engagement with an outer conductor (a shielding conductor (13)) of the coaxial cable to be mechanically fixed to the coaxial cable, so that the outer conductor of the coaxial cable is electrically connected with the grounding contact member.

Another previously proposed coaxial cable connector (a coaxial connector (1)) disclosed in the published patent document 2 comprises a signal contact member (a terminal (2)) having an inner conductor connecting portion (a connecting portion (2*a*)) with which an inner conductor (a core conductor (21)) of a coaxial cable (20) is connected and a pair of engaging portions (contacting portions (2*b*)) each extended from the inner conductor connecting portion, a grounding contact member (an outer conductor (4)) having an annular coupling portion (a tubular portion (4*a*)) and a shell portion (an outer lid portion (4*b*)) extended from the annular coupling portion to be bendable, and an insulating housing (an insulator (3)) provided for supporting the signal contact member and the grounding contact member in a condition of mutual isolation. In the published patent document 2 disclosing such a coaxial cable connector, namely, the coaxial connector (1) as described above, it is disclosed that it is possible for the coaxial connector (1) to connect electrically the inner conductor of the coaxial cable with the inner conductor connecting portion of the signal contact member by means of ultrasonic welding or electric welding.

The coaxial cable connector proposed previously as disclosed in the published patent document 1, in which such a connection manner that the inner conductor of the coaxial cable is tightly held by the groove provided on the inner conductor connecting portion of the signal contact member and then soldered to the inner conductor connecting portion of the signal contact member to be electrically connected with the same is executed, is accompanied with disadvantages mentioned below.

That is, in the coaxial cable connector proposed previously as disclosed in the published patent document 1, after the inner conductor of the coaxial cable has been soldered to the inner conductor connecting portion of the signal contact member, the solder which had been melted once and then has coagulated remains at a junction wherein the inner conductor of the coaxial cable has been connected with the inner conductor connecting portion of the signal contact member, so that a space occupied with the junction becomes larger in capacity to expand undesirably and it is very likely that the expanded junction obstructs reduction in height of the coaxial cable connector which is generally required. Further, it is very difficult in the coaxial cable connector to control accurately a proper quantity of the solder at the time of soldering the inner conductor of the coaxial cable to the inner conductor connecting portion of the signal contact member and therefore it is likely that the inner conductor of the coaxial cable is connected to the inner conductor connecting portion of the signal contact member with the solder of insufficient or excessive quantity, so that a proper soldering cannot be obtained between the inner conductor of the coaxial cable and the inner conductor connecting portion of the signal contact member. Under a condition wherein the proper soldering is not obtained between the inner conductor of the coaxial cable and the inner conductor connecting portion of the signal contact member, a characteristic impedance of the coaxial cable connector mounted on an end portion of the coaxial cable cannot be correctly kept and this result in that the coaxial cable cannot be connected suitably and stably with the coaxial cable connector.

Then, the description in the published patent document 2 that it is possible for the coaxial cable connector to connect electrically the inner conductor of the coaxial cable with the inner conductor connecting portion of the signal contact member by means of ultrasonic welding or electric welding, is no more than an opinion of possibility of ultrasonic welding or electric welding as conceivable means for connecting the inner conductor of the coaxial cable with the inner conductor connecting portion of the signal contact member, and any concrete or embodied structure, means or method for putting the ultrasonic welding or electric welding into practice is not disclosed in the published patent document 2. For example, for connecting the inner conductor of the coaxial cable with the inner conductor connecting portion of the signal contact member by means of ultrasonic welding, it is essentially required to provide an ultrasonic vibration horn for applying ultrasonic vibrations at least to the inner conductor of the coaxial cable and the ultrasonic vibration horn has usually its three dimensions larger than a diameter of the inner conductor of the coaxial cable and a width of a part of the inner conductor connecting portion of the signal contact member with which the inner conductor of the coaxial cable is connected. However, such a practical configuration as clarifying a shape and size of the ultrasonic vibration horn and arrangement of the ultrasonic vibration horn in relation to the inner conductor of the coaxial cable and the inner conductor connecting portion of the signal contact member, is not shown nor suggested in the published patent document 2. Accordingly, on the occasion of connecting the inner conductor of the coaxial cable with the inner conductor connecting portion of the signal contact member, it is impossible to put the ultrasonic welding into practice on the strength of the published patent document 2.

BRIEF SUMMARY OF THE INVENTION

Accordingly, a first aspect of the present invention provides a coaxial cable connector used for coupling with a mating coaxial connector fixed to a circuit board, which comprises a signal contact member having an inner conductor connecting portion with which an inner conductor of a coaxial cable is to be connected, a grounding contact member with which an outer conductor of the coaxial cable is to be connected, and an insulating housing for supporting the signal contact member and the grounding contact member in a condition of mutual isolation, and which avoids the aforementioned problems and disadvantages encountered with the prior art.

A second aspect of the present invention provides a coaxial cable connector used for coupling with a mating coaxial connector fixed to a circuit board, which comprises a signal contact member having an inner conductor connecting portion with which an inner conductor of a coaxial cable is to be connected, a grounding contact member with which an outer conductor of the coaxial cable is to be connected, and an insulating housing for supporting the signal contact member and the grounding contact member in a condition of mutual isolation, which avoids disadvantages in accompany with soldering for connecting electrically the inner conductor of the coaxial cable with the inner conductor connecting portion of the signal contact member.

A third aspect of the present invention provides a coaxial cable connector used for coupling with a mating coaxial connector fixed to a circuit board, which comprises a signal contact member having an inner conductor connecting portion with which an inner conductor of a coaxial cable is to be connected, a grounding contact member with which an outer conductor of the coaxial cable is to be connected, and an insulating housing for supporting the signal contact member and the grounding contact member in a condition of mutual isolation, in which the inner conductor of the coaxial cable is able to be suitably and surely connected electrically with the inner conductor connecting portion of the signal contact member by means of ultrasonic joining under a condition wherein the coaxial cable connector is subjected to reduction in its height.

A forth aspect of the present invention provides a method of connecting a coaxial cable which has an inner conductor, an outer conductor, an internal insulator put between the inner conductor and the outer conductor for surrounding the inner conductor and an external insulator surrounding the outer conductor, with a coaxial cable connector which comprises a signal contact member having an inner conductor connecting portion with which the inner conductor of the coaxial cable is to be connected, a grounding contact member with which the outer conductor of the coaxial cable is to be connected and an insulating housing for supporting the signal contact member and the grounding contact member in a condition of mutual isolation, with which the inner conductor of the coaxial cable is able to be suitably and surely connected electrically with the inner conductor connecting portion of the signal contact member of the coaxial cable connector by means of ultrasonic joining.

According to the first to third aspects of the present invention, there is provided a coaxial cable connector (hereinafter, referred to as a coaxial cable connector according to the present invention), which comprises a signal contact member having an inner conductor connecting portion with which an inner conductor of a coaxial cable is to be connected and a contact engaging portion extended from the inner conductor connecting portion for engaging with an outside signal contact member, a grounding contact member having an annular coupling portion for coupling with an outside grounding contact member and a shell portion extended from the annular coupling portion to be connected with an outer conductor of the coaxial cable, and an insulating housing for supporting the signal contact member and the grounding contact member in a condition of mutual isolation, wherein the insulating housing is provided with a first hole having a pair of opposite ends, one of which is closed by the inner conductor connecting portion of the signal contact member, and a second hole having a pair of opposite ends, one of which is also closed by the inner conductor connecting portion of the signal contact member which is in a condition of closing the end of the first hole, and positioned to be opposite to the first hole across the inner conductor connecting portion of the signal contact member, wherein the other of opposite ends of the first hole is formed into a first opening operative to allow the inner conductor of the coaxial cable to be put into the first hole so as to come into contact with the inner conductor connecting portion of the signal contact member which is in the condition of closing the end of the first hole and the other of opposite ends of the second hole is formed into a second opening provided to open toward the side opposite to the first opening, and wherein the first hole is operative to allow an ultrasonic vibration horn to be put into the first hole through the first opening thereof for applying ultrasonic vibrations to the inner conductor of the coaxial cable put in contact with the inner conductor connecting portion of the signal contact member which is in the condition of closing the end of the first hole and the second hole is operative to allow an anvil to be put into the second hole through the second opening for coming into contact with the inner conductor connecting portion of the signal contact member so as to be opposite to the inner conductor of the coaxial cable across the inner conductor connecting portion of the signal contact member.

Further, according to the fourth aspect of the present invention, there is provided a method of connecting a coaxial cable with a coaxial cable connector (hereinafter, referred to as a coaxial cable connecting method according to the present invention), which comprises the steps of providing an electrical cable connector comprising a signal contact member having an inner conductor connecting portion with which an inner conductor of a coaxial cable is to be connected and a contact engaging portion extended from the inner conductor connecting portion for engaging with an outside signal contact member, a grounding contact member having an annular coupling portion for coupling with an outside grounding contact member and a shell portion extended from the annular coupling portion to be connected with an outer conductor of the coaxial cable, and an insulating housing for supporting the signal contact member and the grounding contact member in a condition of mutual isolation, wherein the insulating housing is provided with a first hole having a pair of opposite ends, one of which is closed by the inner conductor connecting portion of the signal contact member, and a second hole having a pair of opposite ends, one of which is also closed by the inner conductor connecting portion of the signal contact member which is in a condition of closing the end of the first hole, and positioned to be opposite to the first hole across the inner conductor connecting portion of the signal contact member, wherein the other of opposite ends of the first hole is formed into a first opening operative to allow the inner conductor of the coaxial cable to be put into the first hole so as to come into contact with the inner conductor connecting portion of the signal contact member which is in the condition of closing the end of the first hole and the other of opposite ends of the second hole is formed into a second opening provided to open toward the side opposite to the first opening, and wherein the first hole is operative to allow an ultrasonic vibration horn to be put into the first hole through the first opening thereof for applying ultrasonic vibrations to the inner conductor of the coaxial cable put in contact with the inner conductor connecting portion of the signal contact member which is in the condition of closing the end of the first hole and the second hole is operative to allow an anvil to be put into the second hole through the second opening for coming into contact with the inner conductor connecting portion of the signal contact member so as to be opposite to the inner conductor of the coaxial cable across the inner conductor connecting portion of the signal contact member, causing the inner conductor of the coaxial cable to come into contact with the inner conductor connecting portion of the signal contact member which is in the condition of closing the end of the first hole, putting the anvil into the second hole through the second opening so as to come into contact with the inner conductor connecting portion of the signal contact member which is in the condition of closing the end of the first hole, putting the ultrasonic vibration horn into the first hole through the first opening so as to come into contact with the inner conductor of the coaxial cable put n contact with the inner conductor connecting portion of the signal contact member which is in the condition of closing the end of the first hole, causing the ultrasonic vibration horn to apply the ultrasonic vibrations to the inner conductor of the coaxial cable so that the inner conductor of the coaxial cable is connected electrically with the inner conductor connecting portion of the signal contact member by means of ultrasonic joining, and causing the shell portion of the grounding contact member to come into contact with the outer conductor of the coaxial cable so that the outer conductor of the coaxial cable is electrically connected with the shell portion of the grounding contact member.

The above mentioned coaxial cable connector according to the present invention is mounted on an end of the coaxial cable to be put in practical use. At that time, the inner conductor of the coaxial cable is caused to come into contact with the inner conductor connecting portion of the signal contact member which is in the condition of closing the end of the first hole provided on the insulating housing through the first opening of the first hole, the anvil is put into the second hole provided on the insulating housing through the second opening of the second hole so as to come into contact with the inner conductor connecting portion of the signal contact member which is in the condition of closing the end of the first hole, and the ultrasonic vibration horn is put into the first hole through the first opening of the first hole so as to come into contact with the inner conductor of the coaxial cable put in contact with the inner conductor connecting portion of the signal contact member which is in the condition of closing the end of the first hole. Then, the ultrasonic vibrations are applied from the ultrasonic vibration horn to the inner conductor of the coaxial cable so that the inner conductor of the coaxial cable is connected electrically with the inner conductor connecting portion of the signal contact member, and finally, the shell portion of the grounding contact member is caused to come into contact with the outer conductor of the coaxial cable so that the outer conductor of the coaxial cable is electrically connected with the shell portion of the grounding contact member.

In one embodiment of coaxial cable connector according to the present invention, the insulating housing is also provided, in addition to the first and second holes, with a shaping concavity adjacent to the first hole to have a bottom on which the inner conductor connecting portion of the signal contact member is placed. The shaping concavity has further a guiding opening through which the inner conductor of the coaxial cable caused to come into contact with the inner conductor connecting portion of the signal contact member placed on the bottom of the shaping concavity and is operative to shape the inner conductor of the coaxial cable coming into contact with the inner conductor connecting portion of the signal contact member placed on the bottom of the shaping concavity through the guiding opening.

With such an embodiment of coaxial cable connector according to the present invention as mentioned above, the shaping concavity is operative to shape a top end of the inner conductor of the coaxial cable coming into contact with the inner conductor connecting portion of the signal contact member placed on the bottom of the shaping concavity, and the first hole is operative to allow the ultrasonic vibration horn to be put into the first hole through the first opening for applying the ultrasonic vibrations to an inner portion extending to the top end of the inner conductor of the coaxial cable.

With the above mentioned coaxial cable connecting method according to the present invention, under a situation wherein the electrical cable connector which has the insulating housing provided for supporting the signal contact member and the grounding contact member in the condition of mutual isolation and provided with the first hole having the opposite ends thereof, one of which is closed by the inner conductor connecting portion of the signal contact member, and the second hole having the opposite ends thereof, one of which is closed by the inner conductor connecting portion of the signal contact member and positioned to be opposite to the first hole across the inner conductor connecting portion of the signal contact member, in which the other of opposite ends of the first hole is formed into the first opening operative to allow the inner conductor of the coaxial cable to be put into the first hole so as to come into contact with the inner conductor connecting portion of the signal contact member which is in the condition of closing the end of the first hole and the other of opposite ends of the second hole is formed into the second opening provided to open toward the side opposite to the first opening, and in which the first hole is operative to allow an ultrasonic vibration horn to be put into the first hole through the first opening thereof for applying ultrasonic vibrations to the inner conductor of the coaxial cable put in contact with the inner conductor connecting portion of the signal contact member which is in the condition of closing the end of the first hole and the second hole is operative to allow an anvil to be put into the second hole through the second opening for coming into contact with the inner conductor connecting portion of the signal contact member so as to be opposite to the inner conductor of the coaxial cable across the inner conductor connecting portion of the signal contact member, is prepared in advance, the inner conductor of the coaxial cable is caused to come into contact with the inner conductor connecting portion of the signal contact member which is in the condition of closing the end of the first hole, the anvil is put into the second hole through the second opening of the second hole so as to come into contact with the inner conductor connecting portion of the signal contact member which is in the condition of closing the end of the first hole, and the ultrasonic vibration horn is put into the first hole through the first opening of the first hole so as to come into contact with the inner conductor of the coaxial cable put in contact with the inner conductor connecting portion of the signal contact member. Then, the ultrasonic vibrations are applied from the ultrasonic vibration horn to the inner conductor of the coaxial cable so that the inner conductor of the coaxial cable is connected electrically with the inner conductor connecting portion of the signal contact member by means of ultrasonic joining and in addition the shell portion of the grounding contact member is caused to come into contact with the outer conductor of the coaxial cable so that the outer conductor of the coaxial cable is electrically connected with the shell portion of the grounding contact member.

In one embodiment of coaxial cable connecting method according to the present invention, under a situation wherein the insulating housing of the coaxial cable connector is provided, in addition to the first and second holes, with a shaping concavity adjacent to the first hole to have a bottom on which the inner conductor connecting portion of the signal contact member is placed and the shaping concavity has further an introducing opening through which the inner conductor of the coaxial cable is caused to come into contact with the inner conductor connecting portion of the signal contact member placed on the bottom of the shaping concavity, the inner conductor of the coaxial cable coming into contact with the inner conductor connecting portion of the signal contact member placed on the bottom of the shaping concavity through the introducing opening is shaped into a configuration suitable for contacting with the inner conductor connecting portion of the signal contact member by the shaping concavity.

With the coaxial cable connector or the coaxial cable connecting method thus constituted or proceeded in accordance with the present invention, when the coaxial cable connector is mounted on the end of the coaxial cable, under the situation wherein the inner conductor of the coaxial cable is caused to come into contact with the inner conductor connecting portion of the signal contact member which is in the condition of closing the end of the first hole provided on the insulating housing through the first opening of the first hole, the anvil is put into the second hole provided on the insulating housing through the second opening of the second hole so as to be in contact with the inner conductor connecting portion of the signal contact member which is in the condition of closing the end of the first hole, and the ultrasonic vibration horn is put into the first hole through the first opening of the first hole so as to be in contact with the inner conductor of the coaxial cable put in contact with the inner conductor connecting portion of the signal contact member which is in the condition of closing the end of the first hole, the ultrasonic vibrations are applied from the ultrasonic vibration horn to the inner conductor of the coaxial cable so that the inner conductor of the coaxial cable is connected electrically with the inner conductor connecting portion of the signal contact member by means of ultrasonic joining.

On that occasion, since the first hole having the first opening is provided on the insulating housing of the coaxial cable connector so as to allow the ultrasonic vibration horn to be put into the first hole through the first opening for applying the ultrasonic vibrations to the inner conductor of the coaxial cable which is in contact with the inner conductor connecting portion of the signal contact member which is in the condition of closing the end of the first hole and the second hole having the second opening is provided on the insulating housing so as to allow the anvil to be put into the second hole through the second opening for coming into contact with the inner conductor connecting portion of the signal contact member which is in the condition of closing the end of the first hole to be opposite to the inner conductor of the coaxial cable across the inner conductor connecting portion of the signal contact member, the inner conductor of the coaxial cable which is in contact with the inner conductor connecting portion of the signal contact member between the anvil and the ultrasonic vibration horn, is supplied with the ultrasonic vibrations from the ultrasonic vibration horn which is put in direct contact with the inner conductor of the coaxial cable and thereby the inner conductor of the coaxial cable is electrically connected with the inner conductor connecting portion of the signal contact member by means of ultrasonic joining. As a result, the coaxial cable connector is able to avoid disadvantages in accompany with soldering for connecting electrically the inner conductor of the coaxial cable with the inner conductor connecting portion of the signal contact member and the inner conductor of the coaxial cable is able to be suitably and surely connected electrically with the inner conductor connecting portion of the signal contact member by means of ultrasonic joining under a condition wherein the coaxial cable connector is subjected to reduction in its height.

Further, with the embodiment of coaxial cable connector according to the present invention or the embodiment of coaxial cable connecting method according to the present invention, under the situation wherein the insulating housing of the coaxial cable connector is provided, in addition to the first and second holes, with the shaping concavity adjacent to the first hole to have the bottom on which the inner conductor connecting portion of the signal contact member is placed and the shaping concavity has further the introducing opening through which the inner conductor of the coaxial cable is caused to come into contact with the inner conductor connecting portion of the signal contact member placed on the bottom of the shaping concavity, the inner conductor of the coaxial cable coming into contact with the inner conductor connecting portion of the signal contact member placed on the bottom of the shaping concavity through the introducing opening is shaped into the configuration suitable for contacting with the inner conductor connecting portion of the signal contact member by the shaping concavity and then the inner conductor of the coaxial cable put in contact with the inner conductor connecting portion of the signal contact member which is in the condition of closing the end of the first hole is connected electrically with the inner conductor connecting portion of the signal contact member by means of ultrasonic joining. Therefore, the inner conductor of the coaxial cable is able to be further more suitably and surely connected electrically with the inner conductor connecting portion of the signal contact member by means of ultrasonic joining.

The above, and other objects, features and advantages of the present invention will become apparent from the following detailed description taken in conjunction with the accompanying drawings.

DETAILED DESCRIPTION OF THE INVENTION

Figure 1:
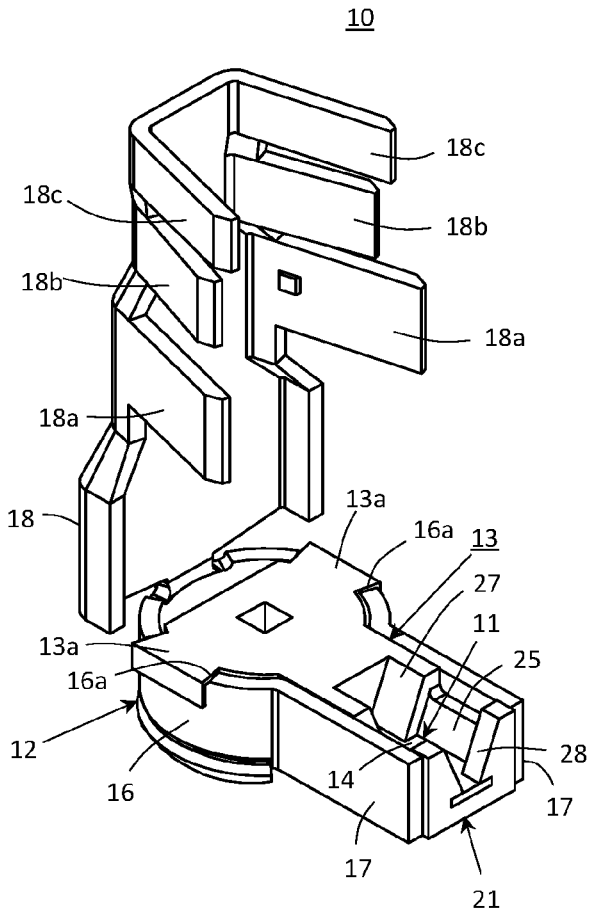
FIG. 1 is a schematic perspective view showing an embodiment of coaxial cable connector according to the present invention.
Figure 2:
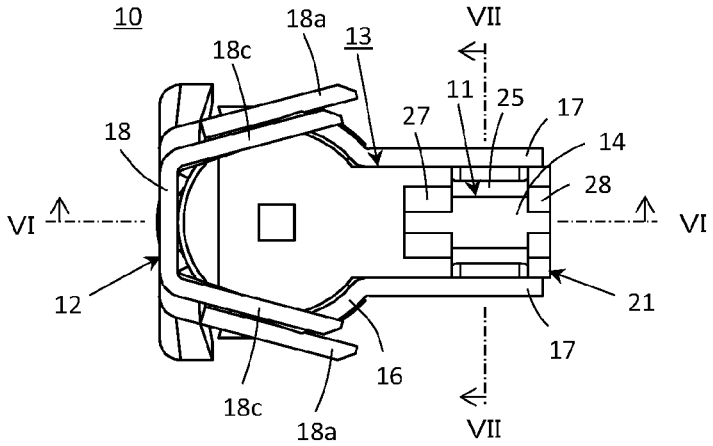
FIG. 2 is a schematic plan view showing the embodiment of coaxial cable connector according to the present invention.

A group of FIG. 1 to FIG. 7 shows an embodiment of coaxial cable connector according to the present invention.

Referring to FIG. 1 to FIG. 7, a coaxial cable connector 10, which constitutes the embodiment of coaxial cable connector according to the present invention, is used to be connected with an end portion of a coaxial cable having an inner conductor and an outer conductor, an example of which is shown as a coaxial cable 30 in FIG. 8 explained later, and coupled with a mating coaxial connector, an example of which is shown as a mating coaxial connector 50 in FIG. 16 explained later, mounted on a surface of a circuit board on which various electrical parts are mounted.

The coaxial cable connector 10 is provided with, as main constitutional elements, a signal contact member 11 made of conductive material, a grounding contact member 12 made of conductive material, and an insulating housing 13 made of insulator, such as a plastics, for supporting the signal contact member 11 and the grounding contact member 12 in such a manner that the signal contact member 11 and the grounding contact member 12 are isolated from each other. The signal contact member 11 is to be electrically connected with the inner conductor of the coaxial cable exposed at the end of the coaxial cable and the grounding contact member 12 is to be electrically connected with the outer conductor of the coaxial cable exposed also at the end of the coaxial cable.

Figure 4:
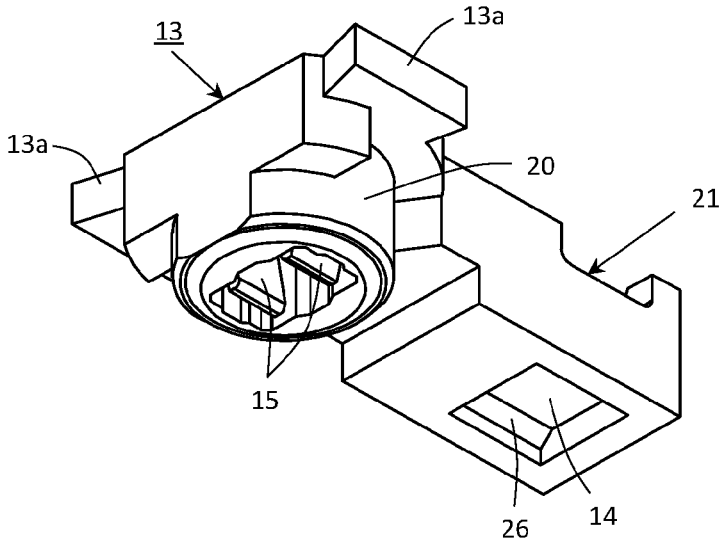
FIG. 4 is a schematic bottom perspective view showing an example of an insulating housing to be employed in the embodiment of coaxial cable connector according to the present invention, together with a signal contact member supported by the insulating housing.
Figure 6:
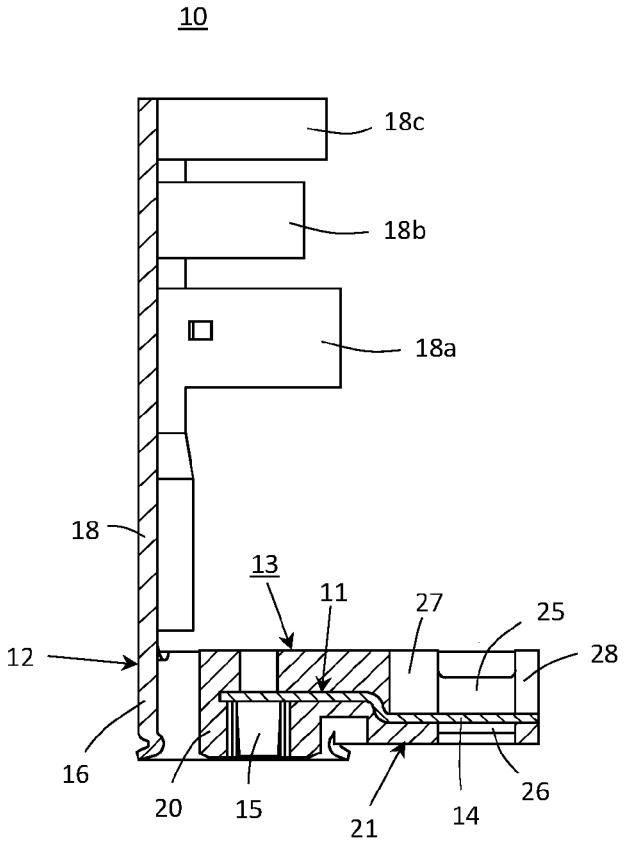
FIG. 6 is a schematic cross sectional view showing a cross section taken along line VI-VI on FIG. 2.
Figure 7:
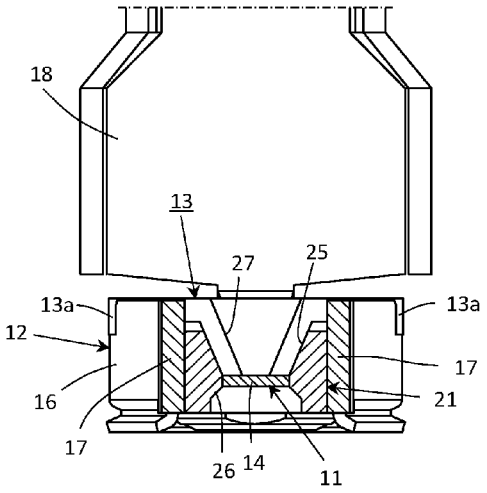
FIG. 7 is a schematic enlarged cross sectional view showing a part of a cross section taken along line VII-VII on FIG. 2.

The signal contact member 11 of the coaxial cable connector 10 has an inner conductor connecting portion 14 with which the inner conductor of the coaxial cable is to be connected and a contact engaging portion 15 extended from the inner conductor connecting portion 14 for engaging with an outside signal contact member as shown in FIG. 4. The inner conductor connecting portion 14 is buried in the insulating housing 13 by means of insert molding, as shown in FIG. 6, in such a manner that a portion of surface of the inner conductor connecting portion 14 is formed into a flat plate piece looking out of the outside from the insulating housing 13. The contact engaging portion 15 is formed into a pair of resilient plate pieces facing each other and elongating in an inside of the insulating housing 13 from an end portion of the inner conductor connecting portion 14 so as to cause a top end of each of the resilient plate pieces to look out on the outside of the insulating housing 13, as shown in FIG. 4 and FIG. 6. The flat plate piece of the inner conductor connecting portion 14 looking out of the outside from the insulating housing 13 is bent down from a portion of the inner conductor connecting portion 14 buried in the insulating housing 13, as shown in FIG. 6.

The grounding contact member 12 of the coaxial cable connector 10 has an annular coupling portion 16, a couple of flat plate portions 17 each extended from the annular coupling portion 16, and a shell portion 18 extended from the annular coupling portion 16 to be bendable and operative to be connected with the outer conductor of the coaxial cable. The annular coupling portion 16 and the flat plate portions 17 are operative to accommodate the major part of the insulating housing 13. The shell portion 18 is operative to cover the annular coupling portion 16, the flat plate portions 17 and the insulating housing 13 accommodated with the annular coupling portion 16 and the flat plate portions 17 when the shell portion 18 is bent toward the annular coupling portion 16 and the flat plate portions 17.

The annular coupling portion 16 of the grounding contact member 12 is provided thereon with a plurality of engaging edged recesses 16*a* in each of which one of engaging projections 13*a* provided on the insulating housing 13 is put to engage with the annular coupling portion 16. With the engaging projections 13*a* of the insulating housing 13 which are put in the engaging edged recesses 16*a* on the annular coupling portion 16 of the grounding contact member 12 respectively to engage with the annular coupling portion 16, the grounding contact member 12 is supported by the insulating housing 13. As a result, the insulating housing 13 supports the signal contact member 11 which is arranged on the inside of the insulating housing 13 and the grounding contact member 12, a major part of which is arranged at the outside of the insulating housing 13, in a condition of mutual isolation.

The shell portion 18 of the grounding contact member 12 comes into contact with the outer conductor of the coaxial cable, the inner conductor of which is connected with the inner conductor connecting portion 14 of the signal contact member 11 when the shell portion 18 of the grounding contact member 12 is bent toward the annular coupling portion 16 and the flat plate portions 17. The shell portion 18 of the grounding contact member 12 is provided with a pair of first bendable engaging portions 18*a* which are operative to be bent to approach each other for engaging with the flat plate portions 17, a pair of second bendable engaging portions 18*b* which are operative to be bent to approach each other for engaging with the outer conductor of the coaxial cable having the inner conductor connected with the inner conductor connecting portion 14 of the signal contact member 11 and a pair of third bendable engaging portions 18*c* which are operative to be bent to approach each other for engaging an outer insulator of the coaxial cable having the inner conductor connected with the inner conductor connecting portion 14 of the signal contact member 11.

Figure 3:
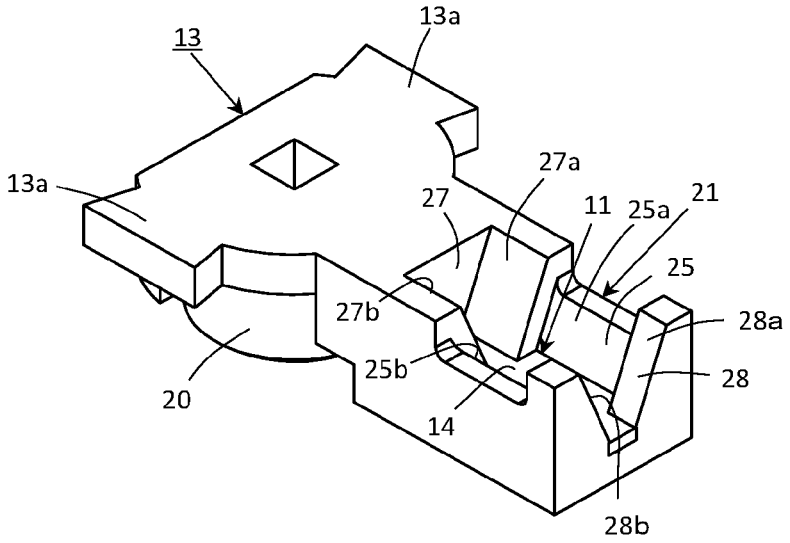
FIG. 3 is a schematic top perspective view showing an example of an insulating housing to be employed in the embodiment of coaxial cable connector according to the present invention, together with a signal contact member supported by the insulating housing.

As shown in each of FIG. 3 and FIG. 4, the insulating housing 13 of the coaxial cable connector 10 has, in addition to the engaging projections 13*a*, a cylindrical portion 20, through the inside of which the contact engaging portion 15 of the signal contact member 11 is to pass, and a cable engaging portion 21 extended from the cylindrical portion 20 for engaging with the inner conductor of the coaxial cable. Under a situation wherein the grounding contact member 12 is supported by the insulating housing 13, the cylindrical portion 20 of the insulating housing 13 is put on the inside of the annular coupling portion 16 of the grounding contact member 12 and the cable engaging portion 21 of the insulating housing 13 is put between the flat plate portions 17 of the grounding contact member 12.

The cable engaging portion 21 of the insulating housing 13 is provided with a first hole 25 having a pair of opposite ends, one of which is closed by the inner conductor connecting portion 14 of the signal contact member 11, and a second hole 26 having a pair of opposite ends, one of which is also closed by the inner conductor connecting portion 14 of the signal contact member 11 which is in a condition of closing the end of the first hole 25, and positioned to be opposite to the first hole 25 across the inner conductor connecting portion 14 of the signal contact member 11. The other of opposite ends of the first hole 25 is formed into a first opening operative to allow the inner conductor of the coaxial cable to be put into the first hole 25 so as to come into contact with the inner conductor connecting portion 14 of the signal contact member 11 which is in the condition of closing the end of the first hole 25 and the other of opposite ends of the second hole 26 is formed into a second opening provided to open toward the side opposite to the first opening. Therefore, the first and second holes 25 and 26 have respectively the first and second openings opposite to each other across the inner conductor connecting portion 14 of the signal contact member 11 to open toward respective opposite directions.

The cable engaging portion 21 of the insulating housing 13 is further provided with a shaping concavity 27 adjacent to the first hole 25 at one of opposing sides thereof with a bottom portion on which the inner conductor connecting portion 14 of the signal contact member 11 is placed and a guiding concavity 28 adjacent to the first hole 25 at the other of opposing sides thereof to be opposite to the shaping concavity 27 via the first hole 25 with a bottom portion thereof on which the inner conductor connecting portion 14 of the signal contact member 11 is placed. Each of the shaping concavity 27 and the guiding concavity 28 has an introducing opening formed to be opposite to the bottom portion for allowing the inner conductor of the coaxial cable to come into contact with the inner conductor connecting portion 14 of the signal contact member 11 placed on the bottom portion of the shaping concavity 27 or the guiding concavity 28.

Comparing the first hole 25 with each of the shaping concavity 27 and the guiding concavity 28, the overall dimension of the first hole 25 including the first opening is larger than the overall dimension of each of the shaping concavity 27 and the guiding concavity 28 each including the introducing opening.

The first hole 25 has further a pair of slant internal surfaces 25*a* and 25*b* which are opposite to each other so that a distance between the slant internal surfaces 25*a* and 25*b* increases gradually from the end of the first hole 25 closed by the inner conductor connecting portion 14 of the signal contact member 11 to the first opening of the first hole 25. The first hole 25 thus constituted is operative to allow an ultrasonic vibration horn for applying ultrasonic vibrations to the inner conductor of the coaxial cable put in contact with the inner conductor connecting portion 14 of the signal contact member 11 which is in the condition of closing the end of the first hole 25 to be put into the first hole 25 through the first opening of the first hole 25 with guidance by the slant internal surfaces 25*a* and 25*b* as required.

The second hole 26 having the second opening thereof is operative to allow an anvil to be put into the second hole 26 through the second opening for coming into contact with the inner conductor connecting portion 14 of the signal contact member 11 which is in the condition of closing the end of the first hole 25 so as to be opposite to the inner conductor of the coaxial cable across the inner conductor connecting portion 14 of the signal contact member 11.

The shaping concavity 27 has a pair of slant internal surfaces 27*a* and 27*b* which are opposite to each other so that a distance between the slant internal surfaces 27*a* and 27*b* increases gradually from the bottom of the shaping concavity 27 to the introducing opening of the shaping concavity 27 and the guiding concavity 28 has a pair of slant internal surfaces 28*a* and 28*b* which are opposite to each other so that a distance between the slant internal surfaces 28*a* and 28*b* increases gradually from the bottom of the guiding concavity 28 to the introducing opening of the guiding concavity 28. The shaping concavity 27 is operative to shape the inner conductor of the coaxial cable which comes into contact with the inner conductor connecting portion 14 of the signal contact member 11 placed on the bottom of the shaping concavity 27 through the introducing opening by means of the slant internal surfaces 27*a* and 27*b*, so that the inner conductor of the coaxial cable is shaped into the configuration suitable for contacting with the inner conductor connecting portion 14 of the signal contact member 11. Further, the guiding concavity 28 is operative to provide the inner conductor of the coaxial cable which comes into contact with the inner conductor connecting portion 14 of the signal contact member 11 placed on the bottom of the guiding concavity 28 through the introducing opening with guidance by means of the slant internal surfaces 28*a* and 28*b*.

Figure 5:
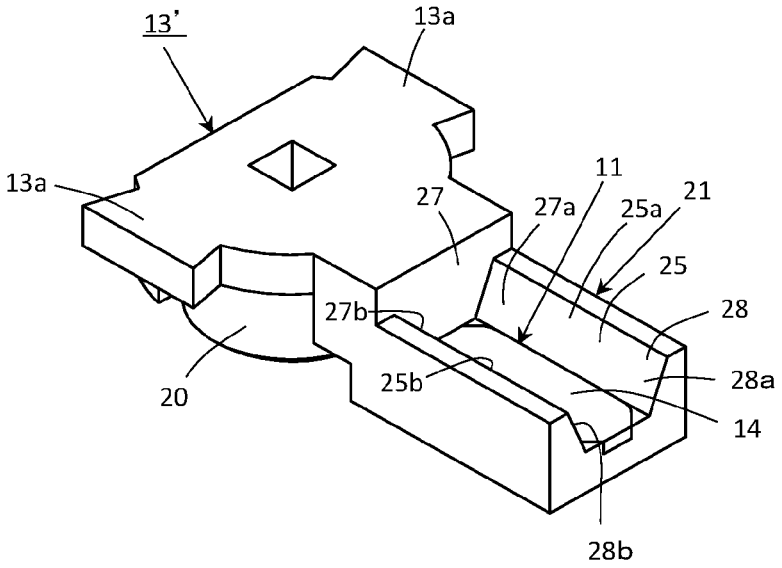
FIG. 5 is a schematic top perspective view showing another example of the insulating housing to be employed in the embodiment of coaxial cable connector according to the present invention, together with the signal contact member supported by the insulating housing.

FIG. 5 shows an insulating housing 13' which constitutes another embodiment of insulating housing to be employed in the coaxial cable connector 10 in place of the insulating housing 13, together with the signal contact member 11 supported by the insulating housing 13'. The insulating housing 13' is also provided with a first hole 25 having a pair of slant internal surfaces 25*a* and 25*b* and a first opening, a second hole 26 having a second opening (not shown in FIG. 5), a shaping concavity 27 having a pair of slant internal surfaces 27*a* and 27*b* and an introducing opening, and a guiding concavity 28 having a pair of slant internal surfaces 28*a* and 28*b* an introducing opening, in the same manner as the insulating housing 13. The overall dimension of the first hole 25 including the first opening is selected to be substantially equal to the overall dimension of each of the shaping concavity 27 including the introducing opening and the guiding concavity 28 including the introducing opening, so that the slant internal surface 25*a* of the first hole 25, the slant internal surface 27*a* of the shaping concavity 27 and the slant internal surface 28*a* of the guiding concavity 28 constitute a first single continuous internal surface and the slant internal surface 25*b* of the first hole 25, the slant internal surface 27*b* of the shaping concavity 27 and the slant internal surface 28*b* of the guiding concavity 28 constitute a second single continuous internal surface opposite to the first single continuous internal surface. Various portions of the insulating housing 13' other than the portions mentioned above are constituted in the same manner as those of the insulating housing 13 shown in FIG. 3 and FIG. 4.

Under a situation wherein the signal contact member 11 and the grounding contact member 12 are supported in the condition of mutual isolation by the insulating housing 13 constituted as described above, as shown in FIG. 6 and FIG. 7, the cylindrical portion 20 of the insulating housing 13 is put on the inside of the annular coupling portion 16 of the grounding contact member 12 and the cable engaging portion 21 of the insulating housing 13 is put between the flat plate portions 17 of the grounding contact member 12. An end portion of the annular coupling portion 16 of the grounding contact member 12 and an end portion of the cylindrical portion 20 of the insulating housing 13 surrounded by the end portion of the annular coupling portion 16 of the grounding contact member 12 constitute a connectively engaging portion of the coaxial cable connector 10 for engaging with a grounding contact member of the mating connector with which the coaxial cable connector 10 is coupled.

In the cable engaging portion 21 of the insulating housing 13, the inner conductor connecting portion 14 of the signal contact member 11, which is buried in the insulating housing 13 by means of insert molding, for example, in the manner that the portion of surface of the inner conductor connecting portion 14 is formed into the flat plate piece looking out of the outside from the insulating housing 13, is put between the first hole 25 and the second hole 26 both provided on the cable engaging portion 21. The contact engaging portion 15 of the signal contact member 11 extended from the end portion of the inner conductor connecting portion 14 of the signal contact member 11 passes through the cylindrical portion 20 of the insulating housing 13 to cause the top end of the contact engaging portion 15 to look out of the outside of the insulating housing 13 at the end portion of the cylindrical portion 20. The top end of the contact engaging portion 15 thus arranged constitutes a connectively engaging portion of the coaxial cable connector 10 for engaging with a signal contact member of the mating connector with which the coaxial cable connector 10 is coupled.

When the coaxial cable connector 10 constituted as mentioned above is mounted on the end of the coaxial cable, one embodiment of coaxial cable connecting method according to the present invention is carried out for connecting the coaxial cable with the coaxial cable connector 10 in such a manner as described below.

Figure 8:
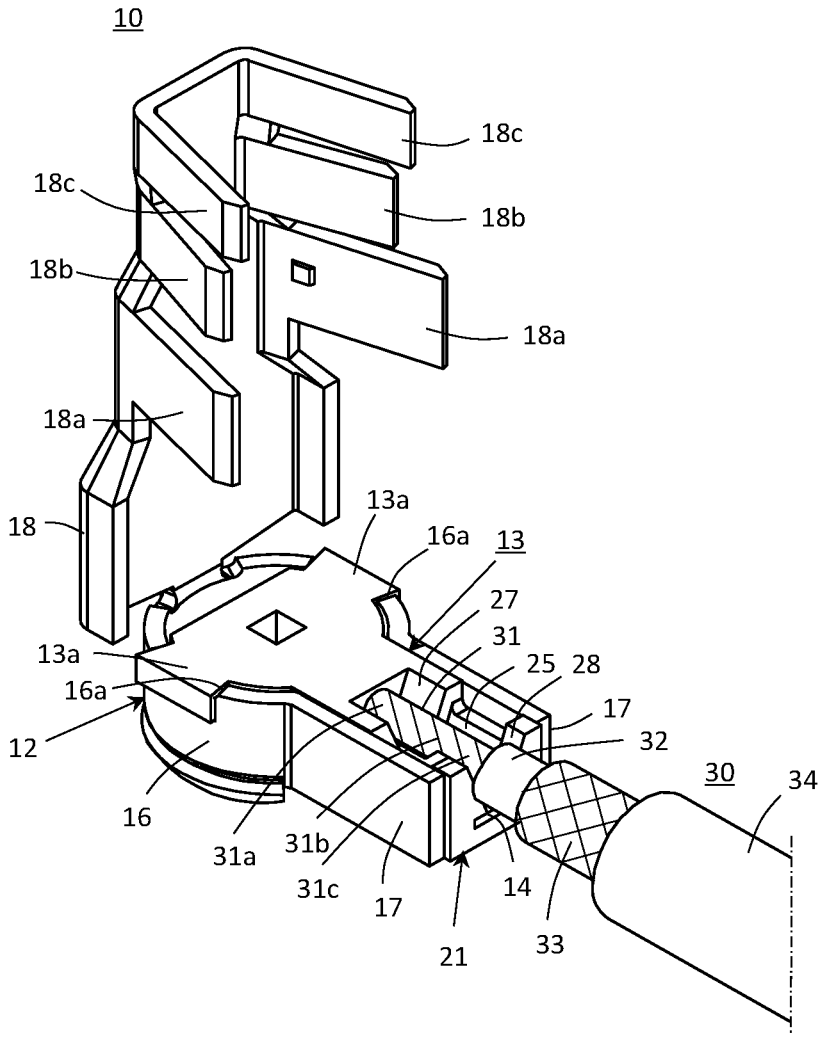
FIG. 8 is a schematic perspective view showing a process of mounting the embodiment of coaxial cable connector according to the present invention on an end portion of a coaxial cable.
Figure 9:
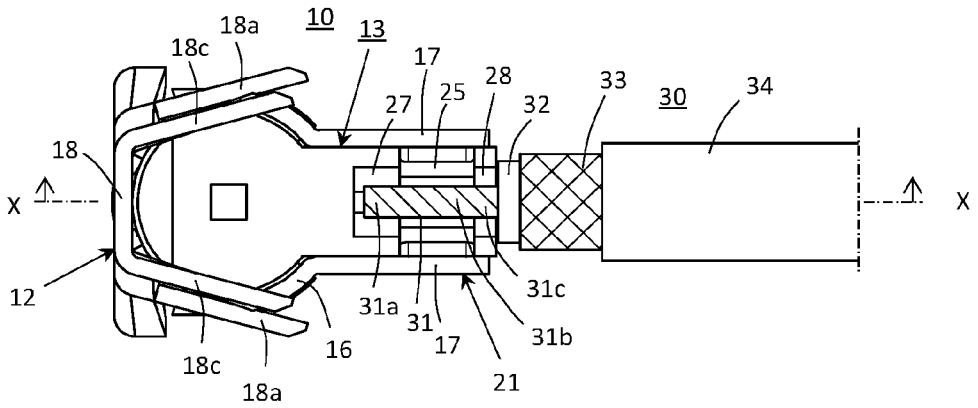
FIG. 9 is a schematic plan view showing the process of mounting the embodiment of coaxial cable connector according to the present invention on the end portion of the coaxial cable.
Figure 10:
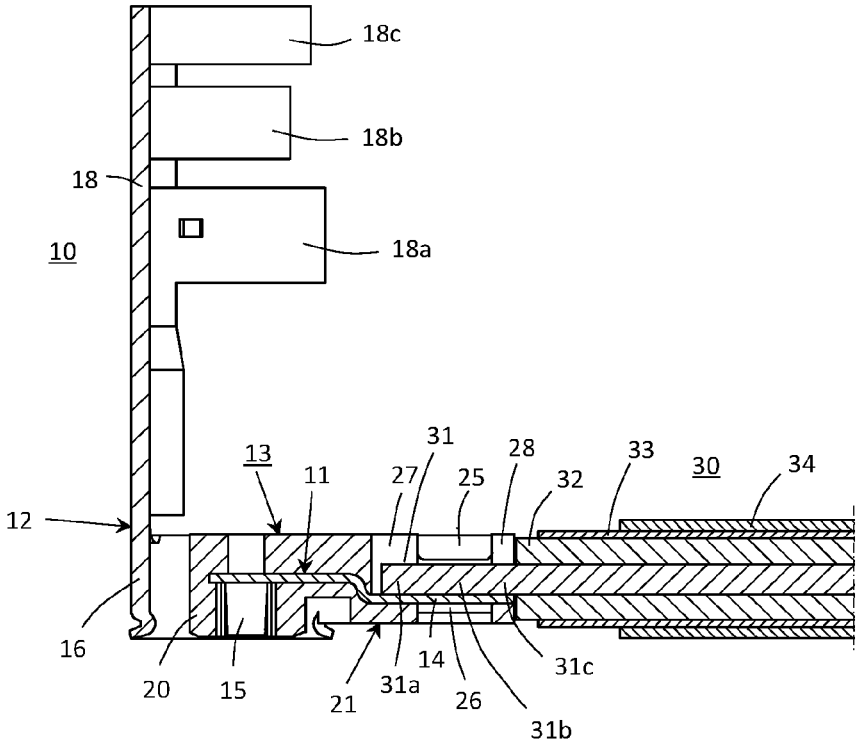
FIG. 10 is a schematic cross sectional view showing a cross section taken along line X-X on FIG. 9.

With the embodiment of coaxial cable connecting method according to the present invention, in the first step, as shown in FIG. 8, FIG. 9 and FIG. 10, an end of the coaxial cable 30, which constitutes an embodiment of coaxial cable accompanied with the coaxial cable connector 10, is engaged with the cable engaging portion 21 of the insulating housing 13 employed in the coaxial cable connector 10. The coaxial cable 30 has an inner conductor 31, an internal insulator 32 surrounding closely the inner conductor 31, an outer conductor 33 surrounding closely the internal insulator 32 and an external insulator 34 surrounding closely the outer conductor 33. The inner conductor 31 comprises a large number of fine conductive wires twisted together, for example. At the end of the coaxial cable 30, a part of the external insulator 34 is cut off so that the outer conductor 33 is exposed, and a part of the outer conductor 33 is cut off to remain partially so that the internal insulator 32 is exposed, and a part of the internal insulator 32 is further cut off to remain partially so that the inner conductor 31 is exposed.

For engaging the end of the coaxial cable 30 with the cable engaging portion 21 of the insulating housing 13, a top end portion 31*a* of the inner conductor 31 exposed at the end of the coaxial cable 30 is caused to come into contact with the inner conductor connecting portion 14 of the signal contact member 11 placed on the bottom of the shaping concavity 27 provided on the cable engaging portion 21 through the introducing opening of the shaping concavity 27, a shallow inner portion 31*b* adjacent to the top end portion 31*a* of the inner conductor 31 is caused to come into contact with the inner conductor connecting portion 14 of the signal contact member 11 which is in the condition of closing the end of the first hole 25 provided on the cable engaging portion 21 through the first opening of the first hole 25, and a deep inner portion 31*c* adjacent further to the shallow inner portion 31*b* of the inner conductor 31 is caused to come into contact with the inner conductor connecting portion 14 of the signal contact member 11 placed on the bottom of the guiding concavity 28 provided on the cable engaging portion 21 through the introducing opening of the guiding concavity 28 under the guidance by means of the slant internal surfaces 28*a* and 28*b* of the guiding concavity 28.

When the top end portion 31*a* of the inner conductor 31 of the coaxial cable 30 is caused to come into contact with the inner conductor connecting portion 14 of the signal contact member 11 placed on the bottom of the shaping concavity 27 through the introducing opening of the shaping concavity 27, the top end portion 31*a* of the inner conductor 31 which comprises a large number of fine conductive wires twisted together, for example, is shaped by the slant internal surfaces 27*a* and 27*b* of the shaping concavity 27, so that the inner conductor 31 of the coaxial cable 30 is configured to be suitable for contacting with the inner conductor connecting portion 14 of the signal contact member 11. Further, when the deep inner portion 31*c* of the inner conductor 31 of the coaxial cable 30 is caused to come into contact with the inner conductor connecting portion 14 of the signal contact member 11 placed on the bottom of the guiding concavity 28 through the introducing opening of the guiding concavity 28, the deep inner portion 31*c* of the inner conductor 31 is guided by the slant internal surfaces 28*a* and 28*b* of the guiding concavity 28 to the bottom of the guiding concavity 28, so that each of the top end portion 31*a* of the inner conductor 31, the shallow inner portion 31*b* adjacent to the top end portion 31*a* of the inner conductor 31 and the deep inner portion 31*c* adjacent to the shallow inner portion 31*b* of the inner conductor 31 is caused to contact suitably with corresponding one of the inner conductor connecting portion 14 of the signal contact member 11 placed on the bottom of the shaping concavity 27, the inner conductor connecting portion 14 of the signal contact member 11 which is in the condition of closing the end of the first hole 25 and the inner conductor connecting portion 14 of the signal contact member 11 placed on the bottom of the guiding concavity 28.

Figure 11:
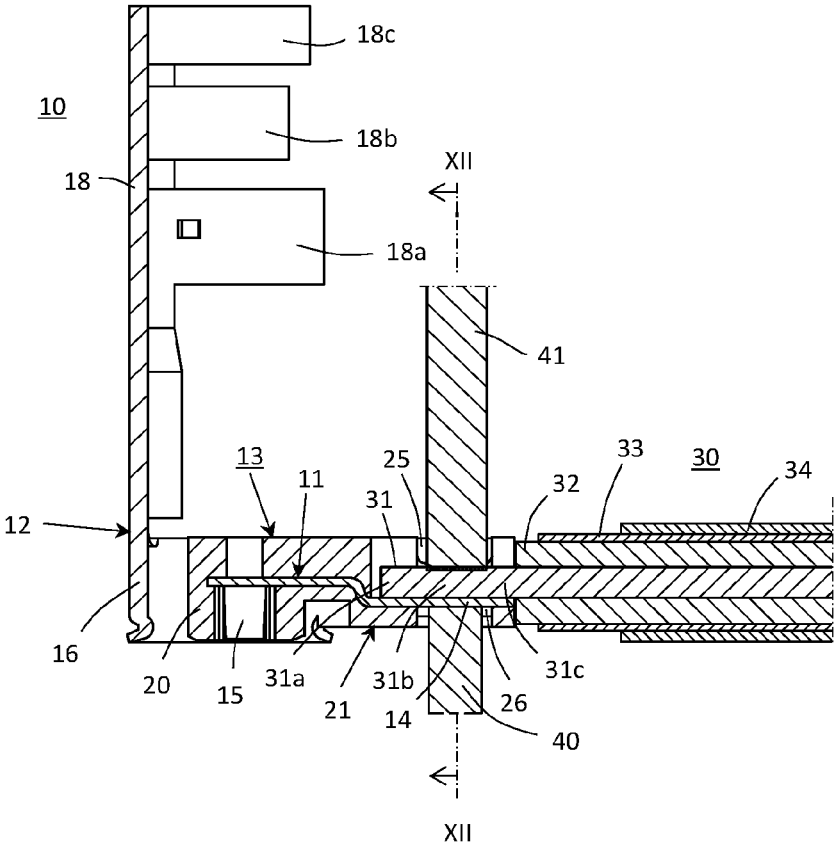
FIG. 11 is a schematic cross sectional view showing a process of mounting the embodiment of coaxial cable connector according to the present invention on the end portion of the coaxial cable.
Figure 12:
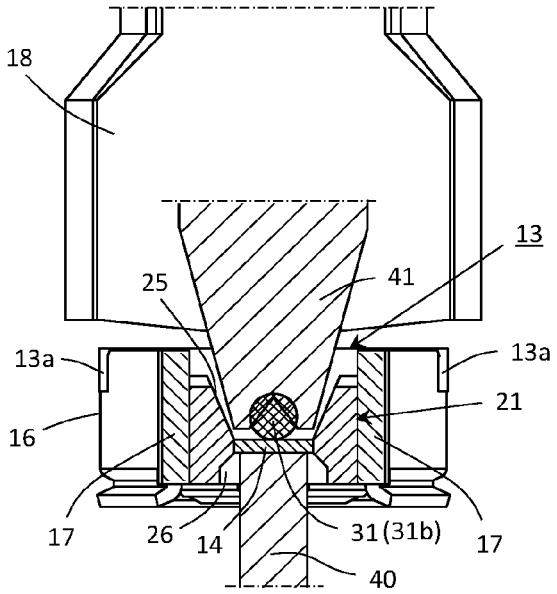
FIG. 12 is a schematic enlarged cross sectional view showing a part of a cross section taken along line XII-XII on FIG. 11.

In the second step, as shown in FIG. 11 and FIG. 12, an anvil 40 is put into the second hole 26 provided on the cable engaging portion 21 of the insulating housing 13 through the second opening of the second hole 26 to come into contact with the inner conductor connecting portion 14 of the signal contact member 11 which is in the condition of closing the end of the first hole 25 and an ultrasonic vibration horn 41 which generates ultrasonic vibrations by an ultrasonic wave having frequency of, for example, around 110 kHz, is put into the first hole 25 provided on the cable engaging portion 21 of the insulating housing 13 through the first opening of the first hole 25 to come into contact with the shallow inner portion 31*b* of the inner conductor 31 of the coaxial cable 30 which is in contact with the inner conductor connecting portion 14 of the signal contact member 11, so that the shallow inner portion 31*b* of the inner conductor 31 of the coaxial cable 30 and the inner conductor connecting portion 14 of the inner signal member 11 with which the shallow inner portion 31*b* of the inner conductor 31 of the coaxial cable 30 is in contact are put between the anvil 40 and the ultrasonic vibration horn 41.

In the third step, the ultrasonic vibrations are applied from the ultrasonic vibration horn 41 put into the first hole 25 to the shallow inner portion 31*b* of the inner conductor 31 of the coaxial cable 30 which is in contact with the inner conductor connecting portion 14 of the signal contact member 11 which is in the condition of closing the end of the first hole 25 so that the shallow inner portion 31*b* of the inner conductor 31 of the coaxial cable 30 is connected electrically with the inner conductor connecting portion 14 of the signal contact member 11 by means of ultrasonic joining. That is, under a condition wherein the shallow inner portion 31*b* of the inner conductor 31 of the coaxial cable 30 and the inner conductor connecting portion 14 of the inner signal member 11 with which the shallow inner portion 31*b* of the inner conductor 31 of the coaxial cable 30 is in contact are put between the anvil 40 and the ultrasonic vibration horn 41, the shallow inner portion 31*b* of the inner conductor 31 of the coaxial cable 30 is connected with the inner conductor connecting portion 14 of the signal contact member 11 by means of ultrasonic joining and thereby the inner conductor 31 of the coaxial cable 30 is connected electrically with the inner conductor connecting portion 14 of the signal contact member 11.

Then, after the shallow inner portion 31*b* of the inner conductor 31 of the coaxial cable 30 has been connected with the inner conductor connecting portion 14 of the signal contact member 11 by means of ultrasonic joining, the ultrasonic vibration horn 41 is pulled out of the first hole 25 provided on the cable engaging portion 21 of the insulating housing 13 and the anvil 40 is pulled out of the second hole 26 provided on the cable engaging portion 21 of the insulating housing 13, so that the cable engaging portion 21 of the insulating housing 13 becomes independent of both of the anvil 40 and the ultrasonic vibration horn 41.

In the fourth step, the shell portion 18 of the grounding contact member 12 is bent toward the annular coupling portion 16 and the flat plate portions 17 of the grounding contact member 12 so as to cover the annular coupling portion 16, the flat plate portions 17 and the insulating housing 13 having the major part thereof accommodated with the annular coupling portion 16 and the flat plate portions 17. Then, the first bendable engaging portions 18*a* provided on the shell portion 18 are bent to approach each other for engaging with the flat plate portions 17, the second bendable engaging portions 18*b* provided on the shell portion 18 are bent to approach each other for engaging with the outer conductor 33 of the coaxial cable 30 having the inner conductor 31 connected with the inner conductor connecting portion 14 of the signal contact member 11, and the third bendable engaging portions 18*c* provided on the shell portion 18 are bent to approach each other for engaging the external insulator 34 of the coaxial cable 30 having the inner conductor 31 connected with the inner conductor connecting portion 14 of the signal contact member 11 and the outer conductor 33 engaged with the second bendable engaging portions 18*b*. Thereby, as shown in FIG. 13, the outer conductor 33 of the coaxial cable 30 is electrically connected with the shell portion 18 of the grounding contact member 12 and the coaxial cable 30 is held by the second bendable engaging portions 18*b* and the third bendable engaging portions 18*c* provided on the shell portion 18 of the grounding contact member 12.

Figure 13:
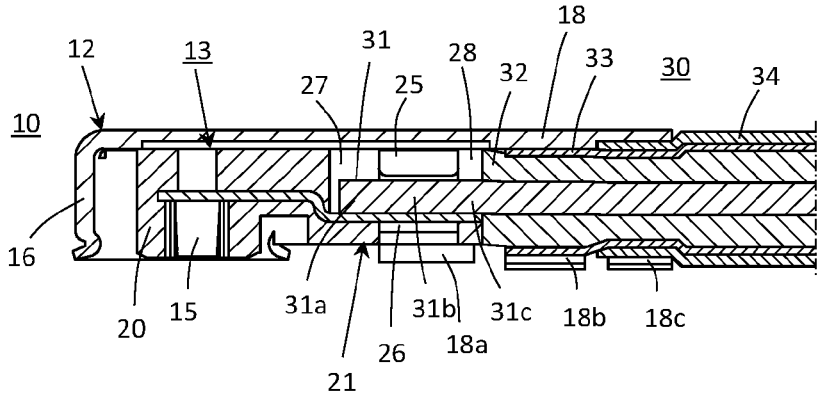
FIG. 13 is a schematic cross sectional view showing the embodiment of coaxial cable connector according to the present invention mounted on the end portion of the coaxial cable.
Figure 14:
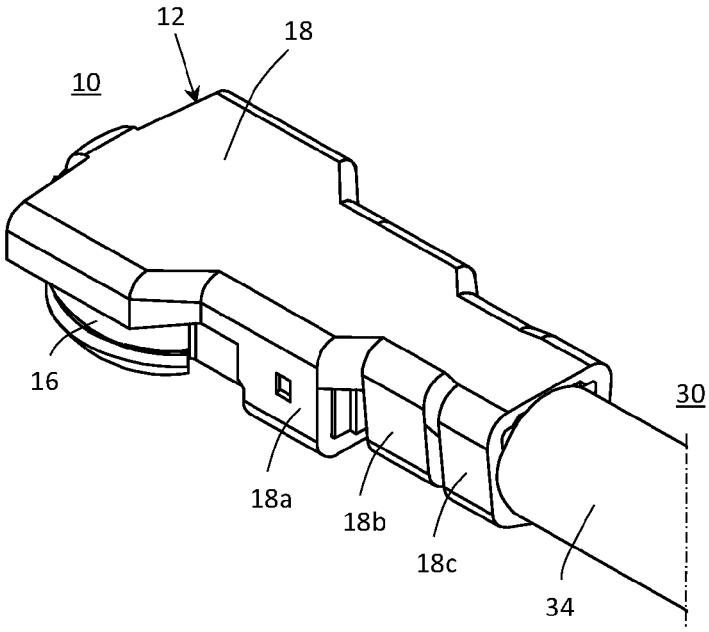
FIG. 14 is a schematic top perspective view showing the embodiment of coaxial cable connector according to the present invention mounted on the end portion of the coaxial cable.
Figure 15:
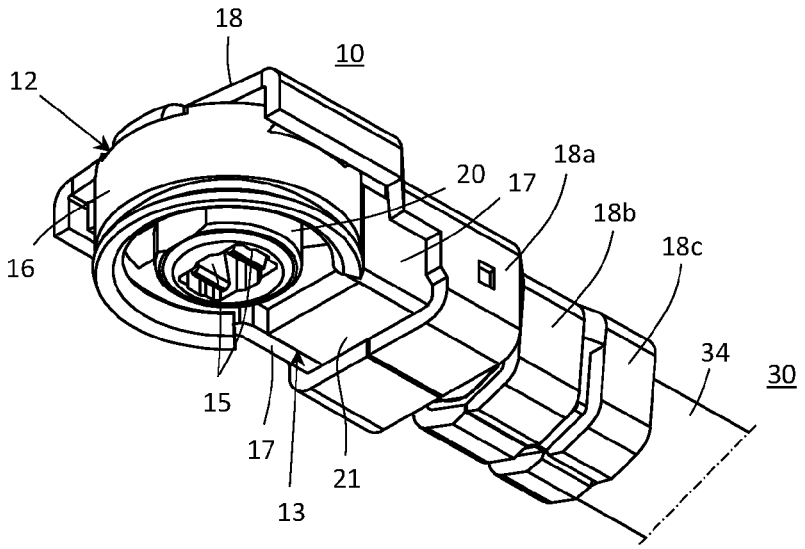
FIG. 15 is a schematic bottom perspective view showing the embodiment of coaxial cable connector according to the present invention mounted on the end portion of the coaxial cable.

As a result, as shown in FIG. 13, FIG. 14 and FIG. 15, the coaxial cable connector 10 in which the signal contact member 11 and the grounding contact member 12 are supported by the insulating housing 13 in the condition of mutual isolation is mounted on the end of the coaxial cable 30 which is provided with the inner conductor 31 connected with the inner conductor connecting portion 14 of the signal contact member 11 and the outer conductor 33 connected with the shell portion 18 of the grounding contact member 12 and held by the second bendable engaging portions 18*b* and the third bendable engaging portions 18*c* provided on the shell portion 18 of the grounding contact member 12.

Figure 16:
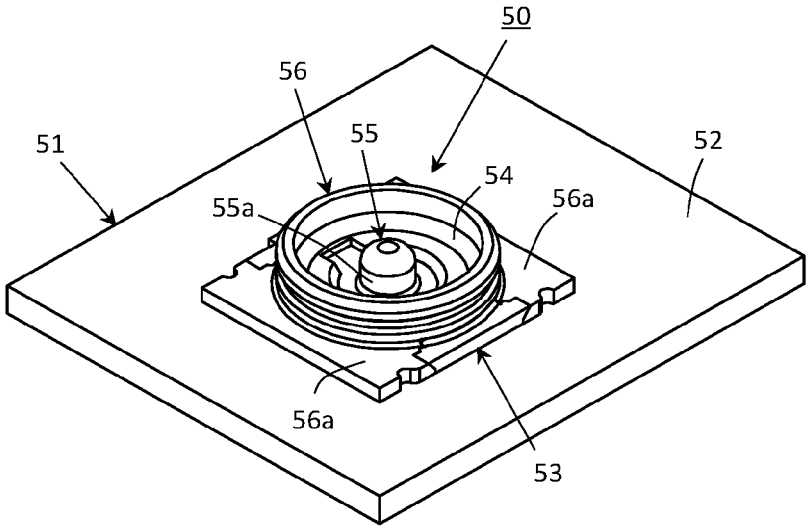
FIG. 16 is a schematic perspective view showing an example of a mating coaxial connector mounted on a circuit board, with which the embodiment of coaxial cable connector according to the present invention is to be coupled.

FIG. 16 shows the mating coaxial connector 50 constituting an example of the mating coaxial connector with which the coaxial cable connector 10 mounted on the end of the coaxial cable 30 is to be coupled, together with a circuit board 51 on which the mating coaxial connector 50 is mounted. The mating coaxial connector 50 is fixed to a surface 52 of the circuit board 51 on which various electrical parts (not shown in the drawings) are mounted.

The mating coaxial connector 50 is provided with a base board 53 made of insulating material such as plastics to be put on the surface 52 of the circuit board 51, so as to cause the mating coaxial connector 50 to be fixed to the surface 52 of the circuit board 51. The base board 53 of the mating coaxial connector 50 has a bottom plane portion facing closely the surface 52 of the circuit board 51 on which the base board 53 is put and a top plane portion opposite to the bottom plane portion. At a central portion of the base board 53, a ring-shaped projection 54 is formed on the top plane portion and an opening (not shown in the drawings) is formed on the inside of the ring-shaped projection 54.

The mating coaxial connector 50 is also provide with a signal contact member 55 fixed to the base board 53. The signal contact member 55 has a central contacting portion 55*a* shaped into a column-like portion to elongate from the bottom plate portion of the base board 53 through the opening formed on the inside of the ring-shaped projection 54 to the top plate portion of the base board 53 and a signal connecting portion (not shown in the drawings) provided on the bottom plate portion of the base board 53 to elongate from the central contacting portion 55*a* to the outside of the base board 53. The central contacting portion 55*a* of the signal contact member 55 is operative to be connected with the contact engaging portion 15 of the signal contact member 11 of the coaxial cable connector 10 coupled with the mating coaxial connector 50 and the signal connecting portion of the signal contact member 55 is operative to be connected, for example, by means of soldering, with a signal terminal (not shown in the drawings) provided on the surface 52 of the circuit board 51.

The mating coaxial connector 50 is further provided with a grounding contact member 56 fixed to the base board 53. The grounding contact member 56 is made of conductive material to be shaped into an annular member for surrounding the central contacting portion 55*a* of the signal contact member 55 on the top plane portion of the base board 53 and provided with a ground connecting portion 56*a* extended from the grounding contact member 56 through the bottom plate portion of the base board 53 to the outside of the base board 53. The grounding contact member 56 is operative to be connected with the annular coupling portion 16 of the grounding contact member 12 of the coaxial cable connector 10 coupled with the mating coaxial connector 50 and the ground connecting portion 56*a* of the of the grounding contact member 56 is operative to be connected, for example, by means of soldering, with a grounding terminal (not shown in the drawings) provided on the surface 52 of the circuit board 51.

Figure 17:
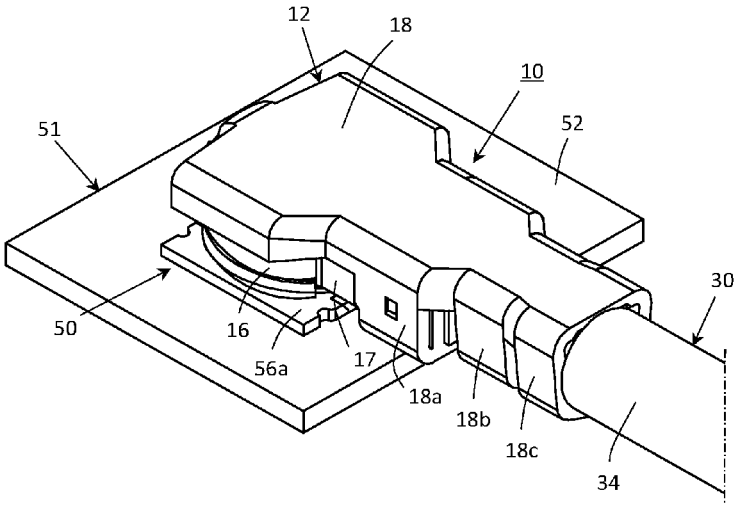
FIG. 17 is a schematic perspective view showing the embodiment of coaxial cable connector according to the present invention coupled with the example of the mating coaxial connector mounted on the circuit board.

Thereby, the coaxial cable connector 10 mounted on the end of the coaxial cable 30 is coupled with the mating coaxial connector 50 fixed to the surface 52 of the circuit board 51 in such a manner as described above, as shown in FIG. 17.

Under a situation wherein the coaxial cable connector 10 mounted on the end of the coaxial cable 30 is coupled with the mating coaxial connector 50 fixed to the surface 52 of the circuit board 51, the annular coupling portion 16 of the grounding contact member 12 of the coaxial cable connector 10 is connected with the grounding contact member 56 of the mating coaxial connector 50, and the cylindrical portion 20 of the insulating housing 13 of the coaxial cable connector 10 is put on the inside of the ring-shaped projection 54 formed on the base board 53 to be surrounded by the grounding contact member 56 of the mating coaxial connector 50 so that the central contacting portion 55*a* of the signal contact member 55 of the mating coaxial connector 50 is inserted into the cylindrical portion 20 of the insulating housing 13 and the contact engaging portion 15 of the signal contact member 11 of the coaxial cable connector 10 passing through the cylindrical portion 20 of the insulating housing 13 engages to be connected with the central contacting portion 55*a* of the signal contact member 55.

As described above, with the annular coupling portion 16 of the grounding contact member 12 of the coaxial cable connector 10 connected with the grounding contact member 56 of the mating coaxial connector 50 in such a manner as described above, the outer conductor 33 of the coaxial cable 30 connected electrically with the grounding contact member 12 of the coaxial cable connector 10 is electrically connected with the grounding terminal provided on the circuit board 51, and with the contact engaging portion 15 of the signal contact member 11 of the coaxial cable connector 10 connected with the central contacting portion 55*a* of the signal contact member 55 of the mating coaxial connector 50 in such a manner as described above, the inner conductor 31 of the coaxial cable 30 connected electrically with the inner conductor connecting portion 14 of the signal contact member 11 of the coaxial cable connector 10 is electrically connected with the signal terminal provided on the circuit board 51.

With the coaxial cable connector 10 constituting the embodiment of coaxial cable connector according to the present invention or the embodiment of coaxial cable connecting method according to the present invention proceeded as described above, when the coaxial cable connector 10 is mounted on the end of the coaxial cable 30, under the situation wherein the inner conductor 31 of the coaxial cable 30 is caused to come into contact with the inner conductor connecting portion 14 of the signal contact member 11 which is in the condition of closing the end of the first hole 25 provided on the insulating housing 13 of the coaxial cable connector 10 through the first opening of the first hole 25, the anvil 40 is put into the second hole 26 through the second opening of the second hole 26 so as to be in contact with the inner conductor connecting portion 14 of the signal contact member 11 which is in the condition of closing the end of the first hole 25, and the ultrasonic vibration horn 41 is put into the first hole 25 through the first opening of the first hole 25 so as to be in contact with the inner conductor 31 of the coaxial cable 30 on the inner conductor connecting portion 14 of the signal contact member 11 which is in the condition of closing the end of the first hole 25, the ultrasonic vibrations are applied from the ultrasonic vibration horn 41 to the inner conductor 31 of the coaxial cable 30 so that the inner conductor 31 of the coaxial cable 30 is connected electrically with the inner conductor connecting portion 14 of the signal contact member 11 by means of ultrasonic joining.

In more detail, the insulating housing 13 of the coaxial cable connector 10 is provided, in addition to the first and second holes 25 and 26, with the shaping concavity 27 adjacent to the first hole 25 to have the bottom on which the inner conductor connecting portion 14 of the signal contact member 11 is placed and the introducing opening and the guiding concavity 28 adjacent also to the first hole 25 to be opposite to the shaping concavity 27 via the concavity 25 with the bottom on which the inner conductor connecting portion 14 of the signal contact member 11 is placed and the introducing opening. With the insulating housing 13 thus constituted, the top end portion 31*a* of the inner conductor 31 of the coaxial cable 30 which is caused to come into contact with the inner conductor connecting portion 14 of the signal contact member 11 placed on the bottom of the shaping concavity 27 through the introducing opening of the shaping concavity 27 is shaped by the shaping concavity 27, the deep inner portion 31*c* of the inner conductor 31 of the coaxial cable 30 which is caused to come into contact with the inner conductor connecting portion 14 of the signal contact member 11 placed on the bottom of the guiding concavity 28 through the introducing opening of the guiding concavity 28 is guided by the guiding concavity 28, and the shallow inner portion 31*b* between the top end portion 31*a* and the deep inner portion 31*c* of the inner conductor 31 of the coaxial cable 30, which is caused to come into contact with the inner conductor connecting portion 14 of the signal contact member 11 which is in the condition of closing the end of the first hole 25 through the first opening of the first hole 25, is subjected to ultrasonic joining with the ultrasonic vibrations from the ultrasonic vibration horn 41 to be electrically connected with the inner conductor connecting portion 14 of the signal contact member 11.

On that occasion, since the first hole 25 having the first opening and the second hole 26 having the second opening are provided on the insulating housing 13 of the coaxial cable connector 10 so as to allow respectively the ultrasonic vibration horn 41 to be put into the first hole 25 through the first opening for applying the ultrasonic vibrations to the inner conductor 31 of the coaxial cable 30 put in contact with the inner conductor connecting portion 14 of the signal contact member 11 which is in the condition of closing the end of the first hole 25 and the anvil 40 to be put into the second hole 26 through the second opening of the second hole 26 for coming into contact with the inner conductor connecting portion 14 of the signal contact member 11 which is in the condition of closing the end of the first hole 25 to be opposite to the inner conductor 31 of the coaxial cable 30 across the inner conductor connecting portion 14 of the signal contact member 11, the inner conductor 31 of the coaxial cable 30 put in contact with the inner conductor connecting portion 14 of the signal contact member 11 between the anvil 40 and the ultrasonic vibration horn 41 is supplied with the ultrasonic vibrations from the ultrasonic vibration horn 41 and thereby the inner conductor 31 of the coaxial cable 30 is electrically connected with the inner conductor connecting portion 14 of the signal contact member 11 by means of ultrasonic joining. As a result, the coaxial cable connector 10 is able to avoid disadvantages in accompany with soldering for connecting electrically the inner conductor 31 of the coaxial cable 30 with the inner conductor connecting portion 14 of the signal contact member 11 and the inner conductor 31 of the coaxial cable 30 is able to be suitably and surely connected electrically with the inner conductor connecting portion 14 of the signal contact member 11 by means of ultrasonic joining under a condition wherein the coaxial cable connector 10 is subjected to reduction in its height.

The invention claimed is:

1. A coaxial cable connector comprising:

a signal contact member having an inner conductor connecting portion with which an inner conductor of a coaxial cable is to be connected and a contact engaging portion extended from the inner conductor connecting portion for engaging with an outside signal contact member, a grounding contact member having an annular coupling portion for coupling with an outside grounding contact member and a shell portion extended from the annular coupling portion to be connected with an outer conductor of the coaxial cable, and an insulating housing for supporting the signal contact member and the grounding contact member in a condition of mutual isolation, wherein the insulating housing is provided with a first hole having a pair of opposite ends, one of which is closed by the inner conductor connecting portion of the signal contact member, and a second hole having a pair of opposite ends, one of which is also closed by the inner conductor connecting portion of the signal contact member which is in a condition of closing the end of the first hole, and positioned to be opposite to the first hole across the inner conductor connecting portion of the signal contact member, wherein the other of opposite ends of the first hole is formed into a first opening operative to allow the inner conductor of the coaxial cable to be put into the first hole so as to come into contact with the inner conductor connecting portion of the signal contact member which is in the condition of closing the end of the first hole and the other of opposite ends of the second hole is formed into a second opening provided to open toward the side opposite to the first opening, and wherein the first hole is operative to allow an ultrasonic vibration horn to be put into the first hole through the first opening of the first hole for applying ultrasonic vibrations to the inner conductor of the coaxial cable put in contact with the inner conductor connecting portion of the signal contact member which is in the condition of closing the end of the first hole and the second hole is operative to allow an anvil to be put into the second hole through the second opening of the second hole for coming into contact with the inner conductor connecting portion of the signal contact member which is in the condition of closing the end of the first hole so as to be opposite to the inner conductor of the coaxial cable across the inner conductor connecting portion of the signal contact member.

2. A coaxial cable connector according to claim 1, wherein the insulating housing is also provided, in addition to the first and second holes, with a shaping concavity adjacent to the first hole to have a bottom on which the inner conductor connecting portion of the signal contact member is placed and the shaping concavity has further a guiding opening through which the inner conductor of the coaxial cable is caused to come into contact with the inner conductor connecting portion of the signal contact member placed on the bottom of the shaping concavity and is operative to shape the inner conductor of the coaxial cable coming into contact with the inner conductor connecting portion of the signal contact member placed on the bottom of the shaping concavity through the guiding opening.

3. A coaxial cable connector according to claim 2, wherein the overall dimension of the first hole including the first opening is larger than the overall dimension of the shaping concavity including the introducing opening.

4. A coaxial cable connector according to claim 2, wherein the shaping concavity has a pair of slant internal surfaces which are opposite to each other so that a distance between the slant internal surfaces increases gradually from the bottom of the shaping concavity to the introducing opening of the shaping concavity.

5. A coaxial cable connector according to claim 2, wherein the shaping concavity is operative to shape a top end portion of the inner conductor of the coaxial cable which comes into contact with the inner conductor connecting portion of the signal contact member placed on the bottom of the shaping concavity and the first hole is operative to allow the ultrasonic vibration horn to be put into the first hole through the first opening for applying ultrasonic vibrations to a shallow inner portion adjacent to the top end portion of the inner conductor of the coaxial cable put in contact with the inner conductor connecting portion of the signal contact member which is in the condition of closing the end of the first hole.

6. A coaxial cable connector according to claim 5, wherein the insulating housing is further provided, in addition to the first and second holes and the shaping concavity, with a guiding concavity adjacent to the first hole to be opposite to the shaping concavity via the first hole and to have a bottom on which the inner conductor connecting portion of the signal contact member is placed, and the guiding concavity has further a guiding opening through which the inner conductor of the coaxial cable is caused to come into contact with the inner conductor connecting portion of the signal contact member placed on the bottom of the guiding concavity and is operative to guide a deep inner portion adjacent to the shallow inner portion of the inner conductor of the coaxial cable to the bottom of the guiding concavity.

7. A method of connecting a coaxial cable with a coaxial cable connector, which comprises the steps of:

providing a coaxial cable connector comprising a signal contact member having an inner conductor connecting portion with which an inner conductor of a coaxial cable is to be connected and a contact engaging portion extended from the inner conductor connecting portion for engaging with an outside signal contact member, a grounding contact member having an annular coupling portion for coupling with an outside grounding contact member and a shell portion extended from the annular coupling portion to be connected with an outer conductor of the coaxial cable, and an insulating housing for supporting the signal contact member and the grounding contact member in a condition of mutual isolation, wherein the insulating housing is provided with a first hole having a pair of opposite ends, one of which is closed by the inner conductor connecting portion of the signal contact member, and a second hole having a pair of opposite ends, one of which is also closed by the inner conductor connecting portion of the signal contact member which is in a condition of closing the end of the first hole, and positioned to be opposite to the first hole across the inner conductor connecting portion of the signal contact member, wherein the other of opposite ends of the first hole is formed into a first opening operative to allow the inner conductor of the coaxial cable to be put into the first hole so as to come into contact with the inner conductor connecting portion of the signal contact member which is in the condition of closing the end of the first hole and the other of opposite ends of the second hole is formed into a second opening provided to open toward the side opposite to the first opening, and wherein the first hole is operative to allow an ultrasonic vibration horn to be put into the first hole through the first opening thereof for applying ultrasonic vibrations to the inner conductor of the coaxial cable put in contact with the inner conductor connecting portion of the signal contact member which is in the condition of closing the end of the first hole and the second hole is operative to allow an anvil to be put into the second hole through the second opening thereof for coming into contact with the inner conductor connecting portion of the signal contact member so as to be opposite to the inner conductor of the coaxial cable across the inner conductor connecting portion of the signal contact member, causing the inner conductor of the coaxial cable to come into contact with the inner conductor connecting portion of the signal contact member which is in the condition of closing the end of the first hole, putting the anvil into the second hole through the second opening so as to come into contact with the inner conductor connecting portion of the signal contact member which is in the condition of closing the end of the first hole, putting the ultrasonic vibration horn into the first hole through the first opening so as to come into contact with the inner conductor of the coaxial cable put in contact with the inner conductor connecting portion of the signal contact member which is in the condition of closing the end of the first hole, causing the ultrasonic vibration horn to apply the ultrasonic vibrations to the inner conductor of the coaxial cable so that the inner conductor of the coaxial cable is connected electrically with the inner conductor connecting portion of the signal contact member by means of ultrasonic joining, and causing the shell portion of the grounding contact member to come into contact with the outer conductor of the coaxial cable so that the outer conductor of the coaxial cable is electrically connected with the shell portion of the grounding contact member.

8. A method of connecting a coaxial cable with a coaxial cable connector according to claim 7, wherein the insulating housing of the coaxial cable connector is provided, in addition to the first and second holes, with a shaping concavity adjacent to the first hole to have a bottom on which the inner conductor connecting portion of the signal contact member is placed, and the shaping concavity has further a guiding opening through which the inner conductor of the coaxial cable is caused to come into contact with the inner conductor connecting portion of the signal contact member placed on the bottom of the shaping concavity and is operative to shape the inner conductor of the coaxial cable coming into contact with the inner conductor connecting portion of the signal contact member placed on the bottom of the shaping concavity through the guiding opening.

9. A method of connecting a coaxial cable with a coaxial cable connector according to claim 8, wherein the insulating housing of the coaxial cable connector is further provided, in addition to the first and second holes and the shaping concavity, with a guiding concavity adjacent to the first hole to be opposite to the shaping concavity via the first hole and to have a bottom on which the inner conductor connecting portion of the signal contact member is placed and a guiding opening through which the inner conductor of the coaxial cable is caused to come into contact with the inner conductor connecting portion of the signal contact member placed on the bottom of the guiding concavity, the shaping concavity is operative to shape a top end portion of the inner conductor of the coaxial cable which comes into contact with the inner conductor connecting portion of the signal contact member placed on the bottom of the shaping concavity, the guiding concavity is operative to guide a deep inner portion of the inner conductor of the coaxial cable to the bottom of the guiding concavity, and the first hole is operative to allow the ultrasonic vibration horn to be put into the first hole through the first opening for applying ultrasonic vibrations to a shallow inner portion between the top end portion and the deep inner portion of the inner conductor of the coaxial cable put in contact with the inner conductor connecting portion of the signal contact member which is in the condition of closing the end of the first hole so that the shallow inner portion of the inner conductor of the coaxial cable is electrically connected with the inner conductor connecting portion of the signal contact member by means of ultrasonic joining.

* * * * *